United States Patent [19]

Evans et al.

[11] 4,328,406

[45] May 4, 1982

[54] CONDITION RESPONSIVE ELECTRICAL SWITCH AND METHOD OF MAKING

[75] Inventors: Thomas E. Evans, Rehoboth; David S. Keyes, Arlington, both of Mass.

[73] Assignee: Texas Instruments Incorporated, Dallas, Tex.

[21] Appl. No.: 63,004

[22] Filed: Aug. 2, 1979

[51] Int. Cl.[3] ..... H01H 35/34

[52] U.S. Cl. ..... 200/293; 200/83 P; 200/67 G; 200/284

[58] Field of Search ..... 200/83 P, 83 N, 83 W, 200/284, 243, 362, 275, 293, 67 G, 73

[56] References Cited

U.S. PATENT DOCUMENTS

| | | | |
|---|---|---|---|
| 3,378,656 | 4/1968 | Johnson | 200/83 P |
| 3,535,480 | 10/1970 | Bahniuk | 200/83 P |
| 3,553,402 | 1/1971 | Hire | 200/83 P |
| 3,773,991 | 11/1973 | Krieger | 200/83 P |
| 4,091,249 | 5/1978 | Huffman | 200/83 P |
| 4,121,073 | 10/1978 | Bileski et al. | 200/243 |
| 4,145,588 | 3/1979 | Orcutt | 200/302 |

*Primary Examiner*—Willis Little

*Attorney, Agent, or Firm*—James P. McAndrews; John A. Haug; Melvin Sharp

[57] ABSTRACT

A condition responsive electrical switch has relatively movable contacts and contact arms and the like secured in precisely predetermined locations relative to each other on a molded dielectric base by sensing the relative positions of the switch components to each other on the base and by fusing portions of the base to the switch components while they are held in the desired spaced relation to each other.

4 Claims, 5 Drawing Figures

CONDITION RESPONSIVE ELECTRICAL SWITCH AND METHOD OF MAKING

BACKGROUND OF THE INVENTION

The field of this invention is that of condition responsive electrical switches in which electrically conductive contacts, terminals and switch arms and the like are adapted to interact with each other and with other switch components such as motion transfer elements and condition responsive metal discs and the like and in which the switch components are mounted for movement from thermally and/or electrically insulated positions to mechanically or electrically interacting positions relative to each other on an organic dielectric base or support.

In many electrical devices, conductive elements are mounted in spaced relation to other device components on reference surfaces which are molded into a dielectric base. In such devices, the bases and other device components are typically of inexpensive manufacture and are adapted to be inexpensively assembled to form low cost devices. However, where condition responsive electrical switches and the like are to be made, and where certain switch components are intended to move from one position to another in response to the occurrence of selected switch operating conditions, it is frequently found that, while the device components can be of inexpensive manufacture it is difficult to assemble the devices to achieve accurate response to the desired switch operating conditions without encountering excessive switch assembly costs.

For example, in the pressure responsive electrical switch shown in U.S. Pat. No. 4,145,588, a pair of electrical terminals is mounted on a cup-shaped dielectric base. One terminal carries fixed contact means and the other terminal carries a resilient spring arm having movable contact means at the distal end of the arm. The base also supports a movable, condition responsive metal disc and mounts a motion transfer member between the spring arm and the disc. The resilient spring arm is intended to normally hold the movable contact means in an open circuit position spaced from the fixed contact means but is adapted to be moved by the motion transfer means in response to movement of the condition responsive metal disc when selected switch operating conditions occur for moving the movable contact means to a closed circuit position engaging the fixed contact means. However, it is found that considerable care has to be exercised in manufacturing and assembling the noted switch components to assure that the switch is accurately responsive to the occurrence of the desired switch operating conditions. As a result the switch devices tend to have higher than intended switch manufacturing costs.

It is an object of this invention to provide a novel and improved condition responsive electrical device and a novel and improved method for making such a device where the device is characterized by relatively movable condition responsive device components mounted on a molded dielectric base.

SUMMARY OF THE INVENTION

In the condition responsive device and method of this invention, a base means is formed of a fusible organic dielectric material or the like. While the base is held in a predetermined position, first device component means including resiliently movable condition responsive means are disposed on the base means in a selected location relative to a second device component so that the condition responsive first means can be moved between alternate positions spaced from or engaging the second component and are adapted to move between such positions in response to the occurrence of predetermined device operating conditions. The first device component means and the second component are then secured in that selected location relative to each other on the base by fusing portions of the base. In that way, an accurately responding condition responsive device is provided in an inexpensive manner.

Preferably, for example, the device comprises a switch base molded with a reference surface thereon. The device also comprises a first terminal having a resilient spring arm attached thereto and having movable contact means at the distal end of the arm, a second terminal having fixed contact means thereon, a condition responsive dished disc element which moves from an original configuration to an inverted dished configuration in response to change in switch operating conditions, and a motion transfer means. In assembling the device, the base is held in selected position by engagement with the base reference surface noted above. The first terminal is then moved relative to the base while the force applied by the resilient spring arm is sensed in various locations on the base. In that way, the first terminal is positioned in a selected location on the base relative to the base reference surface so that the spring arm is adapted to apply a first selected resilient force while disposed at that location. The first terminal is then secured to the base at that selected location by fusing a first portion of the base to the first terminal. While the base is further gripped or engaged at the reference surface for holding the base in a predetermined position, the second terminal is also moved relative to the base to engage the fixed contact means with the movable contact means. The force applied by the spring arm is again sensed at various locations of the second terminal on the base. In that way, the second terminal is positioned in a selected location on the base relative to the first terminal so that the spring arm is adapted to apply a second selected force while disposed in that selected location. The second terminal is then secured to the base at that selected location by fusing second portion of the base to the second terminal. The motion transfer means is then movably mounted on the base to bear against the resilient spring arm and the condition responsive disc is mounted on the base reference surface so that the disc is adapted to move in response to the occurrence of precisely predetermined switch operating conditions. The forces to be applied by the resilient spring arm when the terminals are in said selected locations relative to each other and to the base reference surface are predetermined so that the movable contact means are movable between a first position spaced from the fixed contact means and a second position engaging the fixed contact means and so that, when the device is fully assembled, the condition responsive disc element is adpated to move the movable contact means between said positions in response to the occurrence of selected device operating conditions. In that way, the switch is adapted to be easily and inexpensively manufactured and is easily and reliably assembled to be accurately responsive to the occurrence of desired switch operating conditions.

DESCRIPTION OF THE DRAWING

Other objects advantages and details of the novel and improved device and method of this invention appear in the following detailed description of preferred embodiments of the invention, the detailed description referring to the drawing in which.

Figure 1:
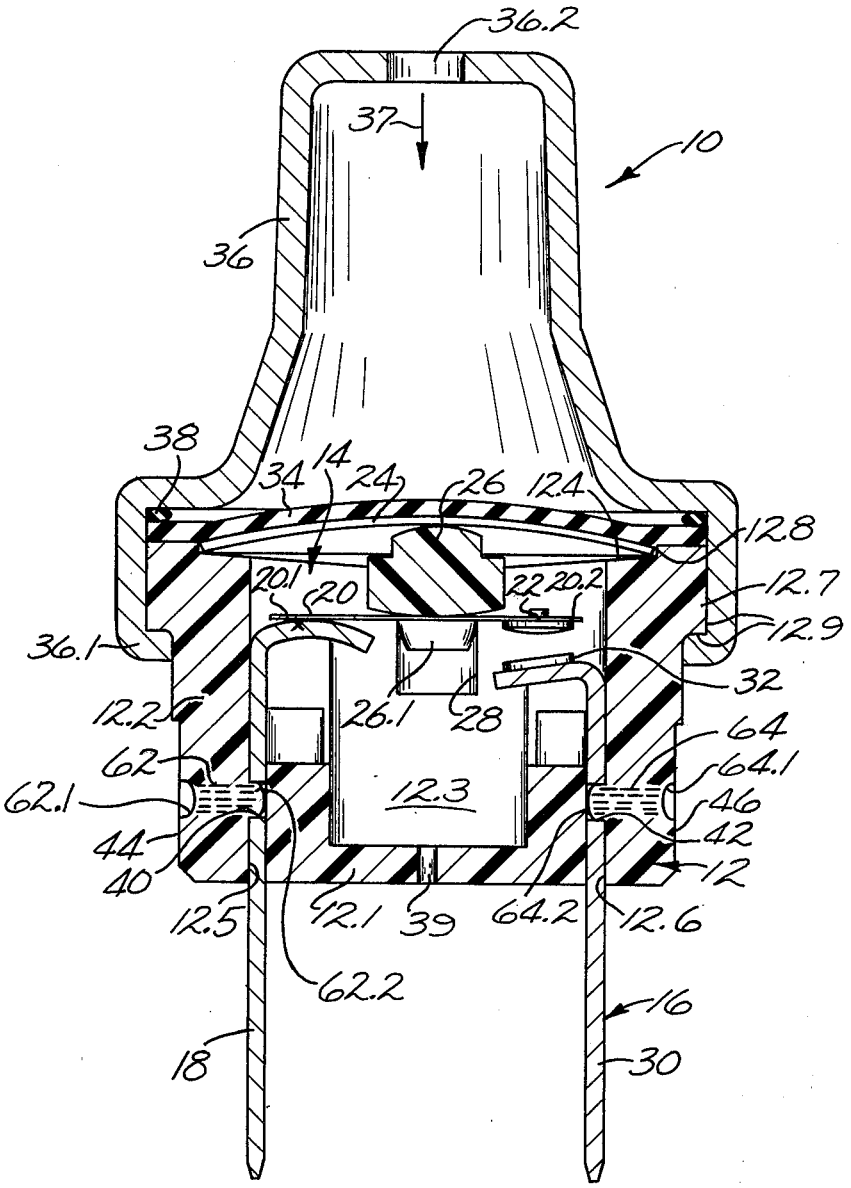
FIG. 1 is a section view along the longitudinal axis of a pressure responsive switch provided by this invention.

Referring to the drawings, 10 in FIG. 1 indicates the novel and improved condition responsive device provided by this invention. Typically the device comprises a pressure responsive electrical switch as shown in FIG. 1 but other condition responsive devices having resiliently movable components mounted for movement relative to each other on an organic base or support or the like are also within the scope of this invention.

In a preferred embodiment of the invention as shown in FIG. 1, the device incorporates a generally cylindrical cup-shaped dielectric base or body 12 having a bottom 12.1 and a side wall 12.2 which define an open ended base chamber 12.3. A typically flat or inwardly tapering reference surface 12.4 is formed on the base at the open end of the chamber, and the base has a pair of terminal openings 12.5, 12.6 which extend from the chamber through the base bottom in a direction generally parallel to the central, longitudinal axis of the base. Preferably the base has a flange 12.7 defining a shoulder 12.8 around the reference surface 12.4 and the flange also provides exterior mounting surfaces 12.9 as discussed below.

In the preferred embodiment of the invention, first device component means 14 are mounted on the base and the device also includes a second device component 16 which is mounted on the base in a selected location relative to the first component. The first component means 14 include resiliently movable condition responsive means the the like and are adapted to move relative to the second device component 16 in response to the occurrence of selected device operating conditions for performing a desired control function or the like.

Preferably for example, the first device component means 14 includes a first terminal 18 and has a resilient electrically conductive spring arm 20 which is secured at one end 20.1 to the first terminal and which carries movable, electrically conductive contact means 22 at the distal end 20.2 of the arm. The first terminal is mounted in one of the base terminal openings 12.5. The first device component means 14 also includes a conventional pressure responsive dished metal disc element 24 which is adapted to move with snap action from the original dished configuration shown in FIG. 1 to an inverted dished configuration when a sufficient pressure force is applied to the convex side of the disc as will be understood. The disc is preferably adapted to return to its original dished configuration when the applied force is sufficiently reduced or removed. The disc is mounted on the base reference surface 12.4 by resting the element rim 24.1 on that surface so that the element extends over the open end of the chamber 12.3 as shown in FIG. 1. The first device component means 14 also includes motion transfer means 26 which are disposed between the disc element 24 and the spring arm 20 to bear or rest against the spring arm for transmitting movement of the element to the arm in a conventional manner. Preferably for example, the motion transfer member 26 has end portions 26.1 (only one of which is shown) which slide in groove means 28 in the dielectric base 12 for guiding movement of the member up and down along the base axis.

The second device component 16 comprises a second electrically conductive terminal 30 having fixed electrical contact means 32 thereon. The second terminal is mounted in another of the terminal openings 12.6 to the base.

In the preferred embodiment of this invention, the base shoulder 12.8 centrally locates the disc element 24 on the base reference surface 12.4 and a flexible membrane or diaphragm 34 or the like of soft, flexible gasket material such as rubber, Kopton or the like is fitted over the disc. A metal cap 36 has a portion 36.1 rolled, swaged or otherwise fitted over the base of the flange 12.7 against the base surfaces 12.9 for holding the disc 24 in position on the base and for seating the diaphragm over the disc. The cap has an opening 36.2 therein through which the disc and membrane are adapted to be exposed to an applied fluid pressure (indicated by the arrow 37 in FIG. 1) in a zone whose pressure is to be monitored. If desired, an 0-ring gasket 38 is clamped between the cap and the membrane 34 for improving device sealing and preferably the base chamber 12.3 has a vent opening 39 therein as shown in FIG. 1.

As thus far described, the device 10 is of conventional structure and is substantially shown in U.S. Pat. No. 4,145,588 as noted above. In that structure, the first terminal 18 mounts the movable contacts 22 so that the spring arm 20 is normally adapted to hold the movable contacts in an open circuit position in spaced electrically insulated relation to the fixed contact means 32. In that arrangement, the spring arm resiliently holds the motion transfer member 26 in the position shown in FIG. 1 and the member normally bears against the condition responsive disc 24 with a small force. However, the disc element is adapted to move to an inverted dished configuration in response to an applied force as will be understood and the disc movement is adapted to be transmitted to the arm 20 through the motion transfer member 26 for moving the movable contacts 22 into engagement with the fixed contact means 32 to close a circuit between the device terminals.

Figure 2:
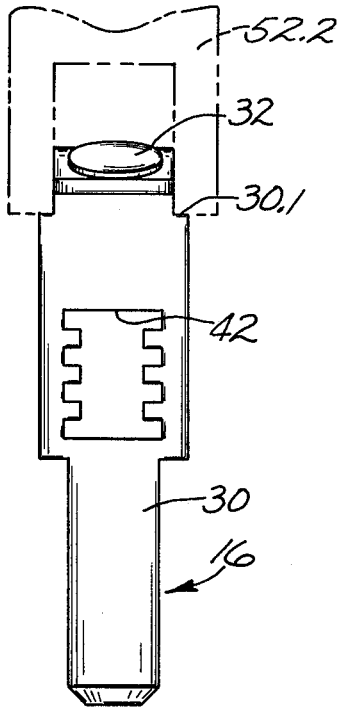
FIG. 2 is a front elevation view of a terminal means used in device of FIG. 1.

In accordance with this invention, however, the device 10 as above described is made in such a way that the device is not only adapted to be accurately responsive to the occurrence of predetermined device operating conditions but is also adapted to be easily and reliably manufactured with those accurate response characteristics at low cost. In this regard, in the device of this invention, the base 12 is formed of a fusible dielectric material such as a phenolic resin or other organic dielectric material or the like. Preferably each of the device terminals 18 and 30 is provided with an opening 40, 42 therein as shown in FIG. 1, each of the openings preferably being slot-like and crenellated as is best seen at 42 in FIG. 2. Preferably also the base has flats 44, 46 provided thereon on opposite exterior sides of the base adjacent the terminal openings 12.5, 12.6 as is best seen in FIG. 1. In that structure, the base and other components of the device 10 are each adapted to be inexpensively manufactured. That is, the base is easily and economically molded with all of the structural features noted above and no difficulty is encountered in providing the base with the single reference surface 12.4. Further, each of the other device components is no more complex than corresponding components in other conventional condition responsive devices.

Figure 3:
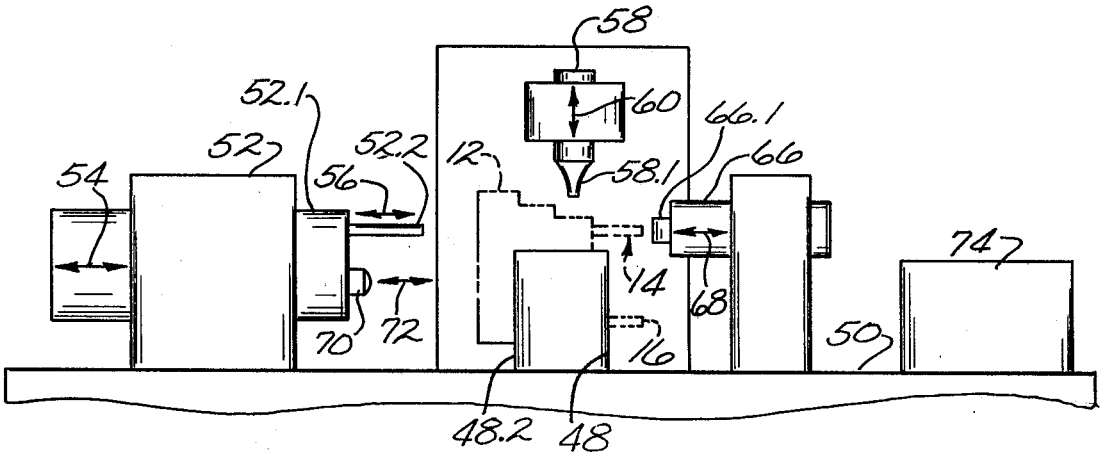
FIG. 3 is a diagrammatic view illustrating apparatus used in assembling the device of FIG. 1.
Figure 4:
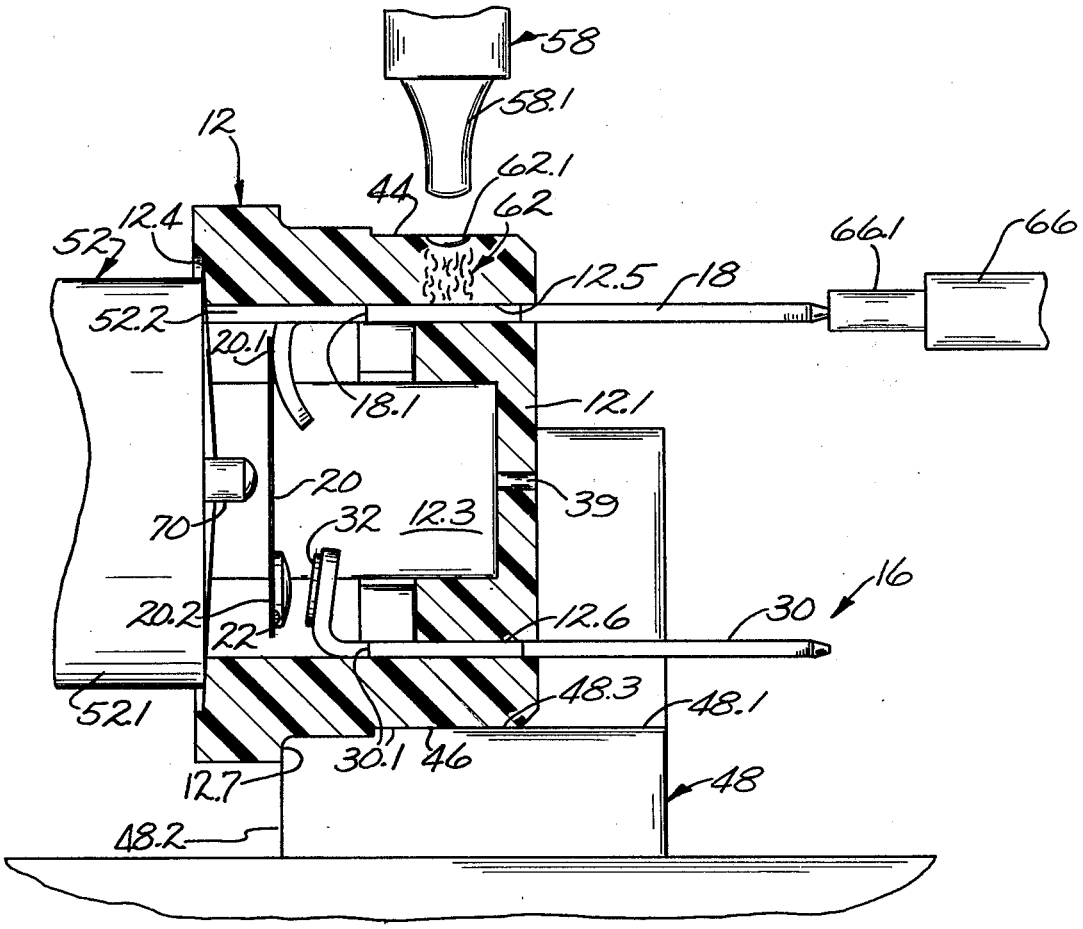
FIG. 4 is a partial section view similar to FIG. 1 illustrating a step in the method of this invention.
Figure 5:
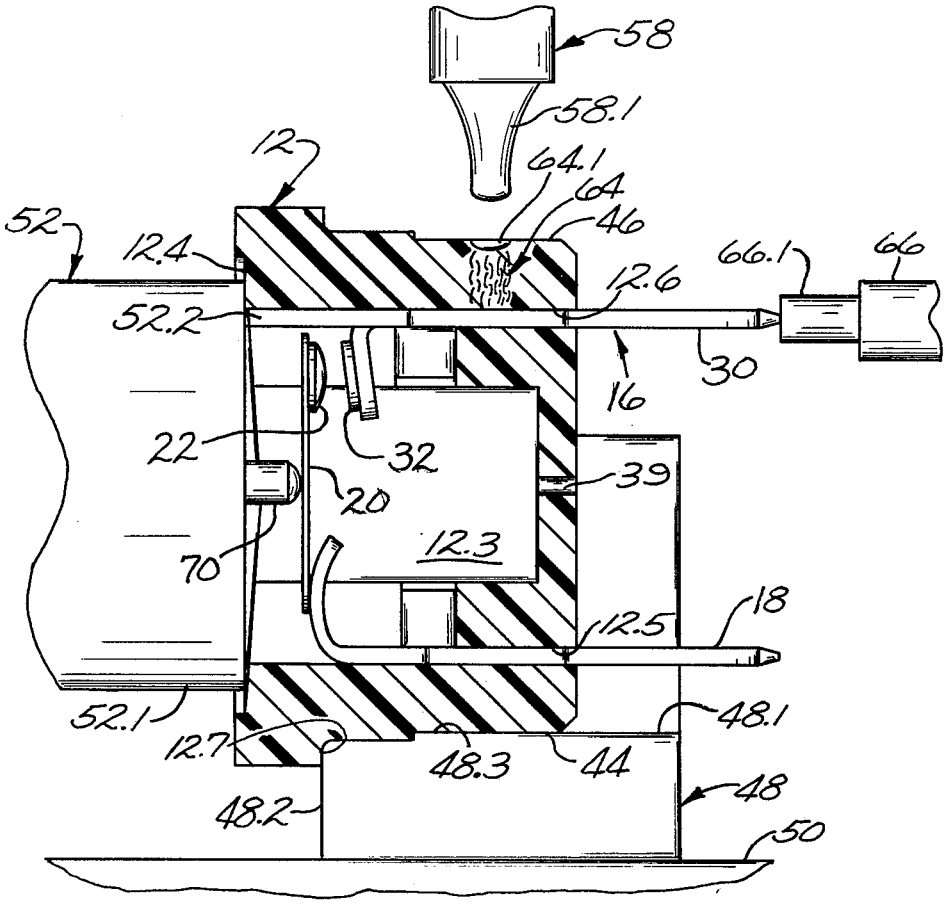
FIG. 5 is a partial section view similar to FIG. 3 illustrating a subsequent step in the method of this invention.

In accordance with this invention, the device 10 is then assembled in the manner diagrammatically illustrated in FIGS. 3–5. That is, the first device terminal 18 and the second device terminal 30 are partially inserted into the terminal openings 12.5, 12.6 in the device base to be disposed in the base chamber 12.3. The base is then located in a mounting block 48 or the like having a semi-circular or U-shaped groove 48.1 therein so that the base flange 12.7 abuts one end 48.2 of the block for locating the base axially relative to the block. Typically the U-shaped groove is configured as indicated at 48.3 to engage a 44 or 46 or other flats on the base thereby to radially orient the base on the block in a selected way with the other flat facing upward as shown in FIGS. 3–5. The mounting block 48 is preferably mounted in a fixed location on a platform 50 as shown diagrammatically in FIG. 3.

The base 12 is then held in a desired position in the block 48 by engaging the base reference surface 12.4 and the first device terminal 18 is pushed to a desired starting position in the opening 12.5. Preferably for example, a terminal setting mechanism 52 is mounted on the platform 50 adjacent to the block 48 and is adapted to be moved in any conventional manner toward and away from the block as is indicated by the arrow 54 in FIG. 3. The mechanism includes a head 52.1 which is adapted to bear against the base reference surface 12.4 for holding the base securely on the block 48 as will be understood. The mechanism also includes a terminal setting arm 52.2 which is adapted to move into and out of the head 52.1 as is diagrammatically indicated in FIG. 3 by the arrow 56 but which is strongly biased by any conventional means (not shown) to extend from the head 52.1 to the extent illustrated in FIG. 3. As the head 52.1 is advanced to engage the base reference surface 12.4 as above-described, the terminal setting arm 52.2 is adapted to engage projections 18.1 on the first component terminal as shown in FIG. 4 (see also FIG. 2) for pushing the terminal into the terminal opening 12.5 to a starting position having substantial spacing from the base reference surface 12.4 as will be understood. The terminal is then backed off from that starting position while the force applied by the resilient spring arm 20 is sensed in any conventional manner for positioning the terminal at a selected location on the base relative to the reference surface 12.4 where the arm is adapted to apply a first selected resilient force.

Preferably for example a stepping motor 66 is mounted on the platform 50 and is adapted in any conventional way to move an arm 66.1 back and forth toward the base 12 as indicated by the arrow 68 in FIG. 3. The terminal setting mechansim 52 is also provided with a sensing means 70 such as a two stage limit switch or other force sensor of any conventional type which may be biased to the position shown in FIG. 3 and adapted to move back and forth into the head 52.2 in the manner indicated by the arrow 72 in FIG. 3 or which may be otherwise responsive to applied force to provice a central signal in conventional manner. The stepping motor is operated to engage the arm 66.1 with the terminal 18 as shown in FIG. 4 so that stepping of the arm motor in a conventional way backs the terminal 18 off from its initial position in the opening 12.5 (pushing the resilient mounted terminal setting arm 52.2 back into the head 52.1) until the spring arm 20 engages the sensor means 70 with sufficient resilient force to trip the first stage of the limit switch to provide a signal for terminating operation of the stepping means in conventional manner. A first portion of the base 12 is then fused for securing the first terminal 18 in that selected location on the base.

Preferably for example a conventional ultrasonic energy transducer 58 is mounted on the platform 50 in any conventional way for movement toward and away from the base 12 as is indicated by the arrow 60 in FIG. 3. When the first terminal 18 is positioned in the desired location on the base 12 as noted above, the transducer is moved toward the base to engage the energy transmitting horn 58.1 of the transducer with the flat 44 on the base for applying ultrasonic energy to the base for locally fusing a first portion 62 of the base material to the terminal 18 for fixedly securing the terminal to the base. Preferably the first fused portion 62 of the base is displaced as it is fused as indicated by the stippling in FIGS. 1, 4 and 5 so that the base is indented as at 62.1 and so that the fused portion 62.2 projects into the opening 12.5 in the base into the opening 40 in the terminal 18 to fuse to the inner side of the opeining 12.5 and around the crenellations in the opening for locking the terminal securely in the desired location on the base. Where the fused portion 62 of the base is formed and displaced in a direction normal to the direction in which the terminal 18 is moved in being positioned on the base as above described, the base is fused without tending to cause any inadvertent disclocation of the terminal on the base.

In the method of this invention, the transducer 58 and the terminal setting means 52 are withdrawn after forming the first fused portion 62 of the base to release the base 12 from the block 48. The base is then radially repositioned on the block with the flat 46 facing upwardly. The terminal setting mechanism is then again advanced so that the head 52.1 engages the base reference surface 12.4 to again locate the base in a selected position on the block 48. As the head 52.1 is advanced, the terminal setting arm engages projections 30.1 on the second terminal 30 (corresponding to projections 18.1 on the first terminal) for initially pushing the terminal 30 to a starting position a substantial distance into the base opening 12.6. The second terminal is then backed off to engage the fixed contact means 32 with the movable contact mwans 22 while the force applied by the spring arm 20 is sensed in any conventional manner for positioning the second terminal at a selected location on the base where the resilient spring arm 20 is adapted to hold the movable contacts engaged with the fixed contacts with a second, selected resilient force. A second portion 64 of the base material is then locally fused for securing the second terminal 30 in that desired location on the base.

That is, the stepping motor 66 is operated to engage the arm 66.1 with the terminal 30 as shown in FIG. 5 so that stepping of the arm in a conventional way steps the terminal 30 off from its initial starting position in the opening 12.6 for engaging the fixed contact means 32 with the movable contact means 22 on the resilient spring arm 20 until the arm engages the sensor means 70 with sufficient resilient force to trip the second stage of the noted limit switch or the like to provide a second signal for terminating operating of the stepping means in a conventional manner.

The ultrasonic transducer 58 is then lowered for forming the second fused portion 64 of the base as will be understood, the fused portion 64 preferably being indented at 64.1 and extending into the opening 42 in the terminal 30 as shown at 64.2 in FIGS. 1 and 5 for locking the terminal in the desired location on the base. In that way, the first terminal 18 with its resilient spring arm and movably mounted contact means are located in precisely located positions on the base relative to the second terminal 30 and to the single base reference surface 12.4 so that assembly of the condition responsive device 10 is adapted to be completed in an economical way to provide a very reliable and accurately responding condition responsive device.

That is, the motion transfer member 26 is positioned in the slot means 28 on the base to bear against the spring arm 20. The disc element is then mounted on the base reference surface 12.4 and the diaphragm 34 and gasket ring 38 are positioned on top of the disc and base. The cap 36 is then swaged to the base for completing the device 10 in conventional manner. In that way, the device 10 is easily, reliably and economically assembled to provide any accurately responsive condition responsive switch or other control device. Device components are adapted for movement between electrically insulated and electrically interacting positions relative to each other on the dielectric device base but are securely, reliably and accurately positioned relative to each other on the base to be accurately responsive to the pressure or other condition responsive means incorporated in the device. Accordingly a novel and advantageous device and method of making the device are achieved.

It should be understood that although particular embodiments of the device and method of this invention have been described by way of illustrating the invention, other modifications and equivalents of the described embodiments are also within the scope of this invention. For example, although portions of the base 12 are shown to be ultrasonically fused for securing device terminals on the base, the fused portions of the base could be formed by heat fusing or in other conventional ways according to this invention. Further, the condition responsive means utilized in the device of this invention could be responsive to change in temperature or to change in other device operating conditions within the scope of this invention. Conventional means other than those shown could also be used for locating the base, for moving device components on the base, and for sensing the relative positions of device components on the base. Further, the sequence of all of the above-described method steps could be regulated by any conventional programmable controller means such as are diagrammatically illustrated at 74 in FIG. 3. This invention includes all modifications and equivalents of the above-described embodiments falling within the scope of the appended claims.

We claim:

1. A condition responsive electrical switch comprising first switch component means of a predetermined configuration having resiliently movable contact means thereon and having a condition responsive dished disc element actuable to move from an original dished configuration to an inverted dished configuration with snap action for moving the movable contact means in response to change in switch operating conditions, a second switch component of a predetermined configuration having fixed contact means thereon, and a base of a fusible organic dielectric material providing a reference surface thereon, said base having separate first and second fused portions securing the first switch component means and the second switch component to the base means in a selected location relative to each other and to said reference surface so that the movable contact means are movable between a first position in spaced electrically insulated relation to the fixed contact means and a second position electrically engaged with the fixed contact means with a selected force and so that the condition responsive means are actuable for moving the movable contact means between said positions in response to the occurrence of preselected device operating conditions.

2. A condition responsive electrical switch comprising a cup-shaped base molded of a fusible organic dielectric material having a chamber open at one end, having a reference surface thereon at the open chamber end and having terminal openings extending through the base in the chamber; a first terminal of a predetermined configuration having a resilient spring arm attached thereto and having movable contact means at the distal end of the arm, the first terminal being fitted into one of the terminal openings for disposing the spring arm in the chamber; a second terminal of a predetermined configuration having fixed contact means thereon fitted into another of the terminal openings for disposing the fixed contact means in the chamber; a condition responsive dished disc element mounted on the base and having a rim portion thereof disposed on the base reference surface so that the element extends over the open chamber end, the element being resiliently movable with snap-action from an original dished configuration to an inverted dished configuration in response to change in switch operating conditions; and motion transfer means movably mounted on the base between the snap disc element and the spring arm for transmitting movement of the element to the spring arm; characterized in that the base has a first fused portion securing the first terminal to the base and a second separate fused portion securing the second terminal to the base with said terminals of said predetermined configurations being secured relative to each other and to said reference surface so that the spring arm resiliently holds the motion transfer means against the disc element to hold the movable contact means in spaced electrically insulated relation to the fixed contact means when the disc is in one of said dished configurations and permits the disc element to move with snap action for moving the motion transfer means and spring arm to engage the movable contact means with the fixed contact means with selected force to close a circuit in response to the occurrence of preselected device operating conditions.

3. A switch as set forth in claim 2 wherein the base has a bottom and a side wall, the terminal openings extend through the base bottom opposite the open chamber end, the first and second terminals extend from the chamber through respective terminal openings, and the fused portions of the base extend into the terminal openings from the base side wall for securing the terminals in said selected positions on the base.

4. A switch as set forth in claim 3 wherein each of the terminals has a crenellated opening therein and the fused portions of the base extend into the respective terminal openings to engage crenellated portions thereof for positively securing the terminals to the base in said relationship to each other and to said reference surface.

* * * * *